US010538824B2

(12) United States Patent
Kang et al.

(10) Patent No.: US 10,538,824 B2
(45) Date of Patent: Jan. 21, 2020

(54) STEEL SHEET AND METHOD FOR PRODUCING SAME

(71) Applicant: Hyundai Steel Company, Incheon (KR)

(72) Inventors: Chun Ku Kang, Dangjin-si (KR); Jin Sung Park, Asan-si (KR); Nam Hoon Goo, Suwon-si (KR); Seong Ju Kim, Yongin-si (KR)

(73) Assignee: Hyundai Steel Company, Incheon (KR)

( * ) Notice: Subject to any disclaimer, the term of this patent is extended or adjusted under 35 U.S.C. 154(b) by 831 days.

(21) Appl. No.: 14/780,505

(22) PCT Filed: Jan. 29, 2014

(86) PCT No.: PCT/KR2014/000846

§ 371 (c)(1),
(2) Date: Sep. 25, 2015

(87) PCT Pub. No.: WO2014/157822

PCT Pub. Date: Oct. 2, 2014

(65) Prior Publication Data

US 2016/0060724 A1 Mar. 3, 2016

(30) Foreign Application Priority Data

| | | |
|---|---|---|
| Mar. 28, 2013 | (KR) | 10-2013-0033942 |
| May 31, 2013 | (KR) | 10-2013-0062725 |
| Aug. 30, 2013 | (KR) | 10-2013-0104077 |
| Jan. 28, 2014 | (KR) | 10-2014-0010355 |

(51) Int. Cl.

| | |
|---|---|
| ***C21D 8/02*** | (2006.01) |
| ***B21B 3/00*** | (2006.01) |
| ***C21D 9/46*** | (2006.01) |
| ***C22C 38/00*** | (2006.01) |
| ***C21D 1/84*** | (2006.01) |
| ***C21D 6/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/38*** | (2006.01) |

(52) U.S. Cl.

CPC ..... *C21D 8/0273* (2013.01); *B21B 3/00* (2013.01); *C21D 1/84* (2013.01); *C21D 6/002* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C21D 9/46* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/38* (2013.01); *C21D 8/02* (2013.01); *C21D 2211/005* (2013.01); *C21D 2211/008* (2013.01)

(58) Field of Classification Search

CPC ..... C22C 38/22; C22C 38/06; C22C 38/38; C22C 38/02; C22C 38/04; C22C 38/001; C22C 38/002; C21D 8/0273; C21D 8/0205; C21D 9/46; C21D 1/84; C21D 6/002; C21D 6/005; C21D 6/008; C21D 8/0226; C21D 8/0236

See application file for complete search history.

(56) References Cited

U.S. PATENT DOCUMENTS

2011/0005643 A1* 1/2011 Murakami ..... C21D 1/25 148/331

FOREIGN PATENT DOCUMENTS

| | | | | | |
|---|---|---|---|---|---|
| CN | 102286696 | A | | 12/2011 | |
| EP | 1972698 | A1 | | 9/2008 | |
| EP | 2184374 | A1 | | 5/2010 | |
| GB | 2 450 066 | | * | 3/2011 | ..... C21D 9/46 |
| JP | 2007-211338 | A | | 8/2007 | |
| JP | 2012-031469 | | * | 2/2012 | ..... C21D 9/48 |
| KR | 10-2000-0016460 | A | | 3/2000 | |
| KR | 2003-0032437 | A | | 4/2003 | |
| KR | 10-0881048 | B1 | | 1/2009 | |
| KR | 10-2011-0069354 | A | | 6/2011 | |
| KR | 10-2011-0119285 | A | | 11/2011 | |
| KR | 10-2012-0033008 | A | | 4/2012 | |
| KR | 10-2012-0132834 | A | | 12/2012 | |
| WO | 2008-082134 | A1 | | 7/2008 | |
| WO | WO-2013018741 | A1 | | 3/2015 | |

OTHER PUBLICATIONS

English Abstract and English Machine Translation of Yamaguchi et al. (JP 2012-031469) (Feb. 16, 2012).*
English Abstract and English Machine Translation of Kikuchi (JP 2011-256404) (Dec. 22, 2011).*
English Abstract and English Machine Translation of Sano et al. (JP 2012-041573) (Mar. 1, 2012).*
Extended European Search Report dated Nov. 22, 2016, of the European Patent Office, in corresponding European Patent Application No. 14776129.0.

(Continued)

*Primary Examiner* — Jessee R Roe
(74) *Attorney, Agent, or Firm* — Locke Lord LLP; Daniel J. Fiorello

(57) ABSTRACT

Disclosed herein are a steel sheet having excellent aging resistance and low yield ratio properties, and a method for producing the same. The disclosed sheet comprises, by weight, 0.005-0.06% carbon (C), 0.2% or less silicon (Si), 1.0-2.0% manganese (Mn), 0.08% or less phosphorus (P), 0.01% or less sulfur (S), 0.2-2.0% aluminum (Al), one or more of chromium (Cr) and molybdenum (Mo) in an amount satisfying $0.3 \leq [Cr\ wt\ \%]+0.3[Mo\ wt\ \%] \leq 2.0$, and 0.008% or less nitrogen (N), with the remainder being iron (Fe) and inevitable impurities, and has a single-phase structure of ferrite in a hot-rolled state, and a two-phase structure of ferrite and martensite in a cold-rolled state.

14 Claims, No Drawings

(56) References Cited

OTHER PUBLICATIONS

State Intellectual Property Office of P.R. China, Notification of First Office Action dated May 19, 2016 in corresponding Chinese Application No. 201480018836.2.
International Search for PCT/KR2014/000846 dated May 13, 2014.

* cited by examiner

STEEL SHEET AND METHOD FOR PRODUCING SAME

CROSS-REFERENCE TO RELATED APPLICATIONS

This application is the national phase under 35 U.S.C. § 371 of PCT International Application No. PCT/KR2014/000846, filed Jan. 29, 2014, which claims benefit and priority of Korean Application No. 10-2013-0033942, filed Mar. 28, 2013; Korean Application No. 10-2013-0062725, filed May 31, 2013; Korean Application No. 10-2013-0104077, filed Aug. 30, 2013; Korean Application No. 10-2014-0010355 filed Jan. 28, 2014; the entire contents of the aforementioned applications are hereby incorporated herein by reference.

TECHNICAL FIELD

The present invention relates to steel sheet production technology, and more particularly, to a steel sheet having excellent aging resistance and low yield ratio properties without having to be subjected to temper rolling, and a method for producing the same.

BACKGROUND ART

Exterior panels for motor vehicles are required to have low yield ratio properties in order to ensure shape fixability during forming processes. On the other hand, formed exterior panels in finished motor vehicles are required to have dent resistance so that they will not be easily deformed by external stress.

Bake-hardening steel is a kind of steel which can satisfy such both properties and in which solid solution carbon remains in the steel so that the yield strength of the final product can be increased by the diffusion of carbon to dislocations in a paint baking process to thereby ensure the dent resistance of the final product. Generally, bake-hardening steel guarantees an increase in yield strength of 3 $kgf/mm^2$ or more.

However, solid solution carbon has some activity even under room temperature conditions other than paint baking conditions, and causes an aging phenomenon and yield point elongation.

The aging phenomenon occurs because solid solution carbon diffuses to mobile dislocations to interfere with the migration of the dislocations. The aging phenomenon also increases in proportion to the amount of solid solution carbon, and a method of controlling the amount of solid solution carbon in steel to about 0.001 wt % has been widely used to inhibit the aging phenomenon. However, the amount of solid solution carbon in steel is changed due to the components of the steel and various process variables in the steel production process, and the steel is exposed to conditions in which the aging phenomenon can occur at any time depending on the storage temperature of the steel.

It has been generally known that bake-hardening steels have aging resistance for 3 months at room temperature. However, in fact, the bake-hardening steels are required to have aging resistance for a longer period of time (about 6-12 months) when taking into consideration the transportation period and the time point of use.

Meanwhile, methods for improving the aging resistance of bake-hardening steel include a method of increasing the density of dislocations in the steel. However, in this method, if the amount of solid solution carbon is large or if low reduction ratio is applied or if suitable temper rolling cannot be performed due to operating conditions, some yield point elongation will remain to cause surface defects, or aging will proceed rapidly within a short period of time to reduce the quality of the steel.

Prior art documents related to the present invention include Korean Patent Laid-Open Publication No. 10-2000-0016460 (published on Mar. 25, 2000), entitled "Coated seizure hardening type cold-rolled steel sheet and production method thereof".

DISCLOSURE

Technical Problem

It is an object of the present invention to provide a steel sheet having excellent aging resistance and low yield ratio properties, and a method for producing the same.

Technical Solution

To achieve the above object, in accordance with an embodiment of the present invention, there is provided a steel sheet comprising, by weight, 0.005-0.06% carbon (C), 0.2% or less silicon (Si), 1.0-2.0% manganese (Mn), 0.08% or less phosphorus (P), 0.01% or less sulfur (S), 0.2-2.0% aluminum (Al), one or more of chromium (Cr) and molybdenum (Mo) in an amount satisfying $0.3 \leq [Cr\ wt\ \%]+0.3[Mo\ wt\ \%] \leq 2.0$, and 0.008% or less nitrogen (N), with the remainder being iron (Fe) and inevitable impurities, the steel sheet having a single-phase structure of ferrite in a hot-rolled state and having a two-phase structure of ferrite and martensite in a cold-rolled state.

The steel sheet may comprise 0.02-0.08 wt % phosphorus (P).

The [Cr wt %]+0.3[Mo wt %] is preferably 0.5-1.5.

The steel sheet preferably comprises 0.3-1.5 wt % chromium (Cr). In this case, the steel sheet may comprise one or more of 0.02-0.08 wt % phosphorus (P) and 0.05-0.4 wt % molybdenum (Mo).

The steel sheet preferably comprises 0.3-1.0 wt % aluminum (Al).

The steel sheet may comprise 5.0-10.0% by area of martensite with the remainder being ferrite, when it is in the cold-rolled state. In this case, the density of dislocations in the ferrite matrix of the steel sheet in the cold-rolled state is $1\times10^{13}/m^2$ or more.

The steel sheet may exhibit a yield ratio (YP/TS) of 0.45 or less.

In accordance with another embodiment of the present invention, there is provided a method for producing a steel sheet, comprising the steps of: (a) reheating a steel slab comprising, by weight, 0.005-0.06% carbon (C), 0.2% or less silicon (Si), 1.0-2.0% manganese (Mn), 0.08% or less phosphorus (P), 0.01% or less sulfur (S), 0.2-2.0% aluminum (Al), one or more of chromium (Cr) and molybdenum (Mo) in an amount satisfying $0.3 \leq [Cr\ wt\ \%]+0.3[Mo\ wt\ \%] \leq 2.0$, and 0.008% or less nitrogen (N), with the remainder being iron (Fe) and inevitable impurities; (b) hot-rolling the reheated steel slab at a temperature equal to or higher than the Ar3 point to obtain a hot-rolled steel sheet; (c) coiling the hot-rolled steel sheet at a temperature between 680° C. and 750° C.; (d) pickling the coiled steel sheet, followed by cold rolling; and (e) annealing the cold-rolled steel sheet at a temperature between 820° C. and 850° C., followed by cooling.

In the method, the annealing is preferably performed such that the volume fraction of austenite is 15-20 vol %.

The cooling may be performed to a temperature ranging from 450 to 510° C. In this case, the method may further comprise the steps of: isothermally transforming the cooled steel sheet; and cooling the isothermally transformed steel sheet to a temperature equal to or lower than the Ms point.

In addition, the cooling may be performed to a temperature equal to or lower than the Ms point.

The cooling is preferably performed at an average cooling rate of 15 to 30° C./sec.

Advantageous Effects

In the method for producing the steel sheet according to the present invention, the hot-rolling process and the annealing process are controlled while alloying components such as chromium and aluminum are controlled. As a result, the steel sheet has a single-phase structure of ferrite in a hot-rolled state and has a two-phase structure of ferrite and martensite in a cold-rolled state.

Particularly, the steel sheet according to the present invention, when contained 5% by area or more of martensite, showed a yield point elongation of less than 0.2% and had a high dislocation density of $1\times10^{13}/m^2$ or more in the ferrite matrix. Thus, according to the steel sheet production method of the present invention, a steel sheet having excellent aging resistance properties for 12 months or more could be produced without having to be subjected to temper rolling.

Furthermore, according to the steel sheet production method of the present invention, a steel sheet having low yield ratio properties (0.45 or less) could be produced as a result of omitting the temper rolling process.

In addition, according to the steel sheet production method of the present invention, if the carbon content is controlled to 0.025 wt % or less and the coiling temperature is controlled to 680° C. or higher, a steel sheet can be produced which shows an elongation of 38% or more and an r-value of 1.2 or more, indicating that the steel sheet has excellent formability.

MODE FOR INVENTION

Hereinafter, a steel sheet according to an embodiment of the present invention and a production method thereof will be described in detail.

Steel Sheet

The steel sheet according to the present invention contains, by weight, 0.005-0.06% carbon (C), 0.2% or less silicon (Si), 1.0-2.0% manganese (Mn), 0.01% or less sulfur (S), 0.2-2.0% aluminum (Al), one or more of chromium (Cr) and molybdenum (Mo) in an amount satisfying $0.3\leq$[Cr wt %]+0.3[Mo wt %]$\leq2.0$, and 0.008% or less nitrogen (N).

In addition, the steel sheet may further contain 0.02-0.08 wt % phosphorus (P).

The steel sheet contains the above-described alloying components with the remainder being iron (Fe) and impurities that are inevitably included during the steel production process and the like.

The functions and contents of components contained in the steel sheet of the present invention will now be described.

Carbon (C)

The martensite structure is a structure containing the supersaturated carbon by diffusionless transformation from the austenite structure, and carbon contributes to the formation of this martensite structure.

Carbon is preferably contained in an amount of 0.005-0.06 wt % based on the total weight of the steel sheet. For the purpose of achieving an elongation of 38% or more, carbon is preferably contained in an amount of 0.005-0.025 wt %. In this carbon content range, the martensite structure can be obtained without greatly reducing the elongation of the steel sheet, and aging resistance can also be ensured by this martensite structure. If the carbon content is less than 0.005 wt %, it will be difficult to form the martensite structure. On the contrary, if the carbon content is more than 0.06 wt %, the strength of the steel sheet will excessively increase and the elongation will decrease, resulting in a decrease in the formability of the steel sheet.

Silicon (Si)

Silicon (Si) is added as a deoxidizing agent to remove oxygen from steel in the steel making process. In addition, silicon contributes to the improvement in strength of the steel sheet by solid solution strengthening.

Silicon is preferably contained in an amount of 0.2 wt % or less, more preferably 0.1 wt % or less, based on the total weight of the steel sheet. If the content of silicon is more than 0.2 wt %, there will be a problem in that a large amount of oxide is formed on the steel sheet surface to reduce the processability of the steel sheet.

Manganese (Mn)

Manganese is an effective hardening element, and contributes to the formation of martensite during cooling after annealing.

Manganese is preferably contained in an amount of 1.0-2.0 wt % based on the total weight of the steel sheet. If the content of manganese is less than 1.0 wt %, the effect of manganese added will be insufficient. On the contrary, if the content of manganese is more than 2.0 wt %, the phase transformation temperature of the steel sheet will decrease, and a phase change will be caused by recrystallization before development of the <111>/ND texture, resulting in a decrease in formability, and surface oxidation of manganese can also cause surface quality problems.

Sulfur (S)

Sulfur (S) can form MnS to reduce the effective manganese content and to cause surface defects by MnS.

For this reason, in the present invention, the content of sulfur is limited to 0.01 wt % or less based on the total weight of the steel sheet.

Aluminum (Al)

Aluminum (Al) that is used in the present invention is an element that serves as a deoxidizing agent. Particularly, it is an element that can delay the Ac3 transformation to thereby increase the concentration of carbon in austenite. In addition, it is an element effective in making a hard austenite phase even with a low carbon content of 0.06 wt % or less in the cooling process following annealing.

Aluminum is preferably contained in an amount of 0.2-2.0 wt %, more preferably 0.3-1.0 wt %, based on the total weight of the steel sheet. If the content of aluminum is less than 0.2 wt %, the fraction of austenite will increase rapidly in the two-phase temperature range during annealing to increase variation in the quality of the steel sheet, and the concentration of carbon in austenite will also decrease, and thus carbide structures such as bainite or pearlite will be formed during cooling, resulting in an increase in yield strength, a decrease in aging resistance and a decrease in the hardness of martensite. On the contrary, if the content of aluminum is more than 2.0 wt %, the Ac3 temperature will increase, and thus the two-phase fraction will decrease during annealing, and ultimately the production of martensite will be inhibited. In addition, in this case, there will be problems in that inclusions increase, surface oxidation occurs during annealing, and plating quality is reduced.

Chromium (Cr) and Molybdenum (Mo)

Chromium (Cr) and molybdenum (Mo) are elements that can enhance the hardenability of the steel sheet to obtain a martensite structure. However, if the content of chromium is excessively high, the fraction of austenite will increase rapidly during annealing to reduce the concentration of carbon. In addition, if the content of molybdenum is excessively high, the Ac3 temperature will increase to reduce the fraction of austenite, and the increase in the Ac3 temperature causes a decrease in productivity in a general continuous annealing line. Furthermore, the change in effects caused by the contents of chromium and molybdenum is remarkable in the case of chromium.

Based on this fact, the present inventors have conducted studies over a long period of time, and as a result, have found that, when chromium and molybdenum in the alloy composition of the steel sheet according to the present invention satisfy the following condition, they contribute to obtaining a martensite structure without causing problems by the excessive contents of chromium and molybdenum:

$$0.3 \leq [\text{Cr wt \%}]+0.3[\text{Mo wt \%}] \leq 2.0.$$

If [Cr wt %]+0.3[Mo wt %] is less than 0.3, chromium and molybdenum will not exhibit a sufficient effect on improvement in the hardenability of the steel sheet. On the contrary, if [Cr wt %]+0.3[Mo wt %] is more than 2.0, the problem caused by the excessive addition of chromium or molybdenum can occur. More preferably, [Cr wt %]+0.3[Mo wt %] is $0.5 \leq$[Cr wt %]+0.3[Mo wt %]$\leq 1.5$ in terms of securely obtaining martensite.

Meanwhile, chromium is more preferably contained in an amount of 0.3-1.5 wt % based on the total weight of the steel sheet. In this case, the steel sheet according to the present invention may contain one or more of 0.02-0.08 wt % phosphorus (P) and 0.05-0.4 wt % molybdenum (Mo).

Nitrogen (N)

Nitrogen (N) causes inclusions in steel to reduce the internal quality of the steel sheet.

For this reason, in the present invention, the content of nitrogen is limited to 0.008 wt % or less based on the total weight of the steel sheet.

Phosphorus (P)

Phosphorus (P) partially contributes to an increase in strength, and can exhibit the effect of improving the texture of the steel sheet. This effect is more significant when the content of phosphorus in the steel sheet is 0.02 wt % or more. Phosphorus is particularly effective in controlling the r-value in the 45° direction. However, if phosphorus is excessively contained in an amount of more than 0.08 wt % based on the total weight of the steel sheet, it can cause surface defects by segregation, as well as brittleness problems.

For this reason, when phosphorus is intentionally added, the content of phosphorus is preferably 0.02-0.08 wt % based on the total weight of the steel sheet.

Meanwhile, in the case of the steel sheet according to the present invention, niobium and titanium are carbonitride-forming elements, and when these elements are excessively added, these increase the yield strength of the steel sheet and also reduce the content of solid solution carbon to interfere with the formation of martensite. Thus, these elements are preferably not added, and when these elements are contained in the steel sheet, the content of each of these elements is preferably limited to less than 1 wt %.

As a result of controlling the alloying components as described and the processes as described below, the steel sheet according to the present invention can have a single-phase structure of ferrite in a hot-rolled state and have a two-phase structure of ferrite and martensite in a cold-rolled state. More specifically, the steel sheet according to the present invention may comprise 5.0-10.0% by area of martensite with the remainder being ferrite, when it is in the cold-rolled state. As a result, the steel sheet according to the present invention can show a yield point elongation of less than 0.2% in the cold-rolled state. Thus, the steel sheet according to the present invention can guarantee aging resistance for 12 months or more. If the yield point elongation is 0.2% or more, surface defects will be caused by stretcher strain during processing, and aging will proceed rapidly.

In addition, the density of dislocations in the ferrite matrix of the steel sheet according to the present invention can be $1\times10^{13}/m^2$ or more. This high dislocation density enables sufficient mobile dislocations to be obtained, thereby inhibiting the room temperature aging phenomenon. Thus, the steel sheet according to the present invention can have excellent aging resistance.

In addition, the steel sheet according to the present invention can show a yield ratio (YP/TS) of 0.45 or less as a result of controlling the alloying components as described and omitting the temper rolling process as described below.

Furthermore, the steel sheet according to the present invention can show an elongation of 38% or more, when the carbon content thereof is controlled to 0.025 wt % or less.

Additionally, the steel sheet according to the present invention can show an r-value of 1.2 or more as a result of controlling the coiling temperature in the production process as described below to 680° C. or higher.

Method for Production of Steel Sheet

A method for producing the steel sheet according to the present invention comprises a slab reheating step, a hot-rolling step, a coiling step, a cold-rolling step and an annealing step.

In the slab reheating step, a steel slab having the above-described alloy composition is reheated to a temperature ranging from about 1100° C. to about 1250° C.

Next, in the hot-rolling step, the reheated steel slab is hot-rolled at a finish-rolling temperature (about 870° C.) equal to or higher than the Ar3 point to obtain a hot-rolled steel sheet. Next, in the coiling step, the hot-rolled steel sheet is cooled, and then coiled.

Herein, the coiling temperature is preferably 680° C. or higher, and more preferably 680 to 750° C. If the coiling temperature is lower than 680° C., second-phase carbides such as pearlite or cementite will remain to cause a shear band that deteriorates the texture of the steel sheet during cold rolling, and austenite having high carbon concentration will be produced in the carbide texture, and thus the elongation of the steel sheet will decrease while the strength of the steel sheet will increase rapidly. For these reasons, the coiling is performed at a temperature of 680° C. or higher to control the hot-rolled structure to a single-phase structure. As used herein, the term "single-phase structure" means the case in which the percentage of a single structure is 99% by area or more, including the case in which the percentage of a single structure is 100% by area.

As described above, the steel sheet according to the present invention has a single-phase structure of ferrite in a hot-rolled state. This can be achieved by controlling the coiling temperature to 680° C. or higher together with control of the alloy composition.

Next, in the cold-rolling step, the coiled steel sheet is pickled, and then cold-rolled at a reduction ratio of about 50-80%.

Next, in the annealing step, the cold-rolled steel sheet is annealed to control the fraction of austenite in order to control the microstructure of the resulting steel sheet.

Herein, the annealing is preferably performed at a temperature between 820° C. and 850° C. for about 50-150 seconds. If the annealing temperature is lower than 820° C., it will be difficult to obtain a sufficient austenite fraction, making it difficult to obtain 5% by weight or more of the martensite phase. On the contrary, if the annealing temperature is higher than 850° C., more than 10% by area of the martensite phase can be formed in the microstructure of the resulting steel sheet due to an excessive austenite fraction.

In the cooling step, the annealed steel sheet is cooled in order to obtain a desired microstructure. Herein, the cooling is preferably performed at an average cooling rate of 15° C./sec or higher, and more preferably 15-30° C./sec. When the average cooling rate is 15° C./sec or higher, martensite can be produced during cooling, and thus the dislocation density can increase during the phase-change process. However, if the average cooling rate is higher than 30° C./sec, there will be a problem in that the dislocation density excessively increases, resulting in an increase in the yield ratio.

As one example, the cooling may be performed to a temperature ranging from 450° C. to 510° C. In this case, the method may further comprise, after the cooling step, a step of isothermally transforming the steel sheet and cooling the isothermally transformed steel sheet to a temperature equal to or lower than the Ms point. The isothermal transformation process can control the strength and elongation of the steel sheet.

As another example, the cooling may be performed to a temperature equal to or lower than the Ms point. In this case, the isothermal transformation process may further be performed.

The annealing process as described above makes it possible to obtain a microstructure comprising 5.0-10.0% by area of martensite with the remainder being ferrite.

Meanwhile, the method may further comprise, after the annealing step, a step of hot-dipping the steel sheet. The hot dipping may be performed either by hot-dip galvanizing at a temperature ranging from about 450° C. to about 510° C., or by hot-dip galvanizing at a temperature ranging from about 450° C. to about 510° C., followed by alloying heat treatment at a temperature ranging from about 500° C. to about 550° C.

EXAMPLES

Hereinafter, the construction and effects of the present invention will be described in further detail with reference to preferred examples. It is to be understood, however, that these examples are for illustrative purposes only and are not intended to limit the scope of the present invention in any way. The contents not described herein can be readily envisioned by those skilled in the art, and thus the detailed description thereof is omitted.

1. Production of Steel Sheet Specimens

Steel slabs, which comprise the components shown in Table 1 below with the remainder being iron and impurities, were reheated at a temperature of 1200° C. for 2 hours, and then hot-rolled to obtain hot-rolled steel sheets. The hot-rolling was performed under finish rolling conditions at 870° C. corresponding to a temperature equal to or higher than the Ar3 point. Each of the hot-rolled steel sheets was cooled and coiled at 700° C. Then, the coiled steel sheets were pickled and cold-rolled at a reduction ratio of 60%. The cold-rolled steel sheets were annealed at 830° C. for 100 seconds, and then cooled to 300° C. at a rate of 20° C./sec, thereby producing steel sheet specimens 1 to 5 and 8.

Steel sheet specimen 6 was produced in the same manner as specimen 1, except that annealing was performed at 790° C., and the steel sheet was cooled to 300° C. at a rate of 20° C./sec, and then temper-rolled at a reduction ratio of 0.5%.

In addition, steel sheet specimen 7 was produced in the same manner as specimen 1, except that the coiling temperature was 600° C.

TABLE 1

(unit: wt %)

| Steel type. | C | Mn | P | S | Al | Nb | Cr | Mo | Remarks |
|---|---|---|---|---|---|---|---|---|---|
| 1 | 0.015 | 1.5 | 0.01 | 0.003 | 0.6 | — | 0.5 | 0.3 | Inventive steel |
| 2 | 0.025 | 1.5 | 0.01 | 0.003 | 0.4 | — | 1.0 | 0.2 | Inventive steel |
| 3 | 0.020 | 1.5 | 0.01 | 0.003 | 0.7 | — | 1.4 | — | Inventive steel |
| 4 | 0.001 | 0.5 | 0.01 | 0.003 | 0.015 | 0.02 | 1.0 | 0.3 | Comparative steel |
| 5 | 0.020 | 1.5 | 0.01 | 0.003 | 0.4 | — | 0.05 | 0.01 | Comparative steel |
| 6 | 0.015 | 1.5 | 0.05 | 0.003 | 0.6 | — | 1.0 | | Inventive steel |

2. Evaluation of Mechanical Properties

Table 2 below shows the microstructure characteristics and mechanical properties of specimens 1 to 7.

The microstructure and dislocation density of each specimen was measured using EBSD (Electron BackScatter Diffraction).

In addition, the dislocation density was evaluated by crystallographic misorientation analysis using EBSD (Electron BackScatter Diffraction), and calculated using the following equation:

$$KAM[\theta]=1/6n\times\Sigma(\theta_1+\theta_2+\ldots+\theta_n)$$

$$L=a(2n+1)$$

$$\rho(\theta)=2*\theta/L*|b|$$

wherein KAM[θ] is kernel average misorientation, θ is misorientation angle, L is unit Length, a is step length, n is the number of kernels, ρ(θ) is dislocation density, and b is burgers vector.

TABLE 2

| Specimen No. | Steel type | Hot-rolled structure | Mechanical properties | | | | | | | | | |
|---|---|---|---|---|---|---|---|---|---|---|---|---|
| | | | Structure | M (area %) | YP | TS | El | YR | r-bar | Yield point elongation (%) | Dislocation density (/m$^2$) | Aging resistance |
| 1 | 1 | F | F + M | 7.1 | 168 | 396 | 40 | 0.42 | 1.42 | 0 | $4.06 \times 10^{13}$ | ◎ |
| 2 | 2 | F | F + M | 8.5 | 174 | 402 | 39 | 0.43 | 1.41 | 0 | $5.61 \times 10^{13}$ | ◎ |
| 3 | 3 | F | F + M | 8.9 | 181 | 427 | 38 | 0.42 | 1.40 | 0 | $5.89 \times 10^{13}$ | ◎ |
| 4 | 4 | F | F | 0 | 292 | 404 | 40 | 0.72 | 1.80 | 3.1 | $0.45 \times 10^{13}$ | Δ |
| 5 | 5 | F | F | 0.9 | 261 | 384 | 38 | 0.68 | 1.39 | 1.6 | $0.62 \times 10^{13}$ | Δ |
| 6 | 1 | F | F + M | 2.5 | 234 | 405 | 38 | 0.58 | 1.12 | 0.8 | $2.94 \times 10^{13}$ | ◎ |
| 7 | 1 | F + P | F + M | 7.6 | 211 | 450 | 36 | 0.47 | 1.10 | 0 | $0.83 \times 10^{13}$ | ○ |
| 8 | 6 | F | F + M | 8.4 | 179 | 416 | 38 | 0.43 | 1.47 | 0 | $5.82 \times 10^{13}$ | ◎ |

※ F: ferrite, M: martensite, P: pearlite

※ Specimen 6: microstructure and mechanical properties after temper rolling

※ Aging resistance: days of occurrence of upper yieid ◎ (12 months or more), ○ (less than 52 months), Δ (less than 6 months)

As can be seen in Table 2 above, steel sheet specimens 1 to 3 and 8 satisfying the conditions specified in the present invention showed a ferrite single-phase structure (99% or more ferrite) in the hot-rolled state and a two-phase structure of ferrite and martensite in the cold-rolled state, and specimen 8 having a phosphorus content of 0.05 wt % showed the highest r-bar value. More specifically, specimens 1 to 3 showed 5% by area or more of martensite, aging resistance for 12 months or more, and a yield ratio of 0.45 or less, indicating that these specimens have excellent aging resistance and low yield ratio properties.

However, specimen 4 containing niobium instead of sufficient amounts of chromium, molybdenum and aluminum did not show a sufficient martensite phase even in the cold-rolled state, indicating that the aging resistance property of specimen 4 is relatively poor.

In addition, in the case of specimen 5 in which sufficient amounts of chromium and molybdenum were not added, a very small amount (less than 1% by area) of martensite was formed, indicating that the aging resistance property of specimen 5 is relatively poor.

Furthermore, in the case of steel sheet specimen 6 in which the annealing temperature was relatively low (790° C.), a relatively small amount of martensite was formed. However, specimen 6 can exhibit aging resistance for 12 months or more as a result of performing temper rolling, but the low yield ratio property thereof was relatively poor. In comparison with this, specimens 1 to 3 and 8 could exhibit excellent low yield ratio properties together with excellent aging resistance properties without having to be subjected to temper rolling.

In addition, steel sheet specimen 7 coiled at a temperature lower than 680° C. had poor processability compared to steel sheet specimens 1 to 3.

Although the preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A steel sheet comprising, by weight, 0.005-0.025% carbon (C), 0.2% or less silicon (Si), 1.0-2.0% manganese (Mn), 0.08% or less phosphorus (P), 0.01% or less sulfur (S), 0.2-2.0% aluminum (Al), chromium (Cr) and molybdenum (Mo) in an amount satisfying 0.8≤[Cr wt %]+0.3[Mo wt %]≤1.5, and 0.008% or less nitrogen (N), with a remainder being iron (Fe) and inevitable impurities, the steel sheet having a two-phase structure of ferrite and martensite in a cold-rolled state, wherein the steel sheet shows a yield ratio (YP/TS) of 0.45 or less, wherein the steel sheet comprises 0.3-1.5 wt % chromium (Cr) and 0.05-0.4 wt % molybdenum (Mo), and wherein the steel sheet has an elongation of 38% or more and the two-phase structure has 5.0-10.0% by area of martensite with the remainder being ferrite.

2. The steel sheet of claim 1, which comprises 0.02-0.08 wt % phosphorus (P).

3. The steel sheet of claim 1, which comprises 0.3-1.0 wt % aluminum (Al).

4. The steel sheet of claim 1, wherein a density of dislocations in a ferrite matrix of the steel sheet in the cold-rolled state is $1\times10^{13}/m^2$ or more.

5. A steel sheet comprising, by weight, 0.005-0.025% carbon (C), 0.2% or less silicon (Si), 1.0-2.0% manganese (Mn), 0.08% or less phosphorus (P), 0.01% or less sulfur (S), 0.2-2.0% aluminum (Al), greater than 0% chromium (Cr) and greater than 0% molybdenum (Mo) in an amount satisfying 0.8≤[Cr wt %]+0.3[Mo wt %]≤1.5, and 0.008% or less nitrogen (N), with a remainder being iron (Fe) and inevitable impurities, the steel sheet having a two-phase structure of ferrite and martensite in a cold-rolled state, wherein the steel sheet shows a yield ratio (YP/TS) of 0.45 or less, wherein the steel sheet has an elongation of 38% or more and the two-phase structure has 5.0-10.0% by area of martensite with the remainder being ferrite.

6. The steel sheet of claim 5, wherein the phosphorous (P) content is 0.02-0.08 wt % phosphorus (P).

7. The steel sheet of claim 5, wherein the aluminum (Al) content is 0.3-1.0 wt % aluminum (Al).

8. The steel sheet of claim 5, wherein a density of dislocations in a ferrite matrix of the steel sheet in the cold-rolled state is $1\times10^{13}/m^2$ or more.

9. A method for producing a steel sheet, comprising the steps of:

reheating a steel slab having an alloy composition by weight of 0.005-0.025% carbon (C), 0.2% or less silicon (Si), 1.0-2.0% manganese (Mn), 0.08% or less phosphorus (P), 0.01% or less sulfur (S), 0.2-2.0% aluminum (Al), one or more of chromium (Cr) and molybdenum (Mo) in an amount satisfying 0.5≤[Cr wt %]+0.3[Mo wt %]≤1.5, and 0.008% or less nitrogen (N), with a remainder being iron (Fe) and inevitable impurities, the steel sheet having a two-phase structure of ferrite and martensite in a cold-rolled state;

hot-rolling the reheated steel slab at a temperature equal to or higher than an Ar3 point to obtain a hot-rolled steel sheet;

coiling the hot-rolled steel sheet at a temperature between 680° C. and 750° C.;

pickling the coiled steel sheet, then cold rolling the pickled coiled steel sheet; and annealing the cold-rolled steel sheet at a temperature between 820° C. and 850° C., followed by cooling.

10. The method of claim 9, wherein the annealing is performed such that a volume fraction of austenite in the steel sheet is 15-20 vol %.

11. The method of claim 9, wherein the cooling is performed to a temperature ranging from 450° C. to 510° C.

12. The method of claim 11, further comprising the steps of:

isothermally transforming the cooled steel sheet; and cooling the isothermally transformed steel sheet to a temperature equal to or lower than an Ms point of the steel sheet.

13. The method of claim 9, wherein the cooling is performed to a temperature equal to or lower than an Ms point of the steel sheet.

14. The method of claim 9, wherein the cooling is performed at an average cooling rate of 5-30° C./sec.

* * * * *